United States Patent [19]

Hardy

[11] Patent Number: 4,677,823

[45] Date of Patent: Jul. 7, 1987

[54] DIESEL ENGINE PARTICULATE TRAP REGENERATION SYSTEM

[75] Inventor: James A. Hardy, Playa Del Rey, Calif.

[73] Assignee: The Garrett Corporation, Los Angeles, Calif.

[21] Appl. No.: 794,346

[22] Filed: Nov. 1, 1985

[51] Int. Cl.[4] ..... F01N 3/02

[52] U.S. Cl. ..... 60/274; 60/286; 60/288; 60/289

[58] Field of Search ..... 60/274, 286, 288, 289

[56] References Cited

U.S. PATENT DOCUMENTS

| | | | |
|---|---|---|---|
| 2,488,563 | 11/1949 | Sills . | |
| 3,131,533 | 5/1964 | Vandenberg . | |
| 3,234,924 | 2/1966 | May . | |
| 3,523,418 | 8/1970 | Marsee . | |
| 3,524,316 | 8/1970 | McKee . | |
| 3,788,284 | 1/1974 | Gardner . | |
| 3,805,521 | 4/1974 | Dafler et al. . | |
| 3,820,328 | 6/1974 | Garcea . | |
| 3,870,083 | 3/1975 | Nezat . | |
| 3,911,675 | 10/1975 | Mondt . | |
| 3,938,330 | 2/1976 | Nakajima et al. . | |
| 3,961,478 | 6/1976 | Lange . | |
| 4,051,821 | 10/1977 | Amann . | |
| 4,211,075 | 7/1980 | Ludecke et al. . | |
| 4,254,752 | 3/1981 | Friddell et al. . | |
| 4,281,512 | 8/1981 | Mills . | |
| 4,381,643 | 5/1983 | Stark . | |
| 4,404,795 | 9/1983 | Oishi et al. . | |
| 4,404,796 | 9/1983 | Wade . | |
| 4,520,624 | 6/1985 | Kiyota | 60/286 |
| 4,541,239 | 9/1985 | Tokura | 60/303 |
| 4,557,108 | 12/1985 | Torimoto | 60/303 |

*Primary Examiner*—Douglas Hart

*Attorney, Agent, or Firm*—J. Henry Muetterties; Curt Harrington; Albert J. Miller

[57] ABSTRACT

A diesel engine exhaust particulate trap and regeneration system for trapping of particulates in the engine exhaust gases and periodic burning thereof. Collected particulates in the trap are burned utilizing a burner means immediately upstream of the trap. An air and fuel supply system are associated with the burner which controls the combustion temperature within the burner in order to completely and efficiently burn the particulates.

14 Claims, 5 Drawing Figures

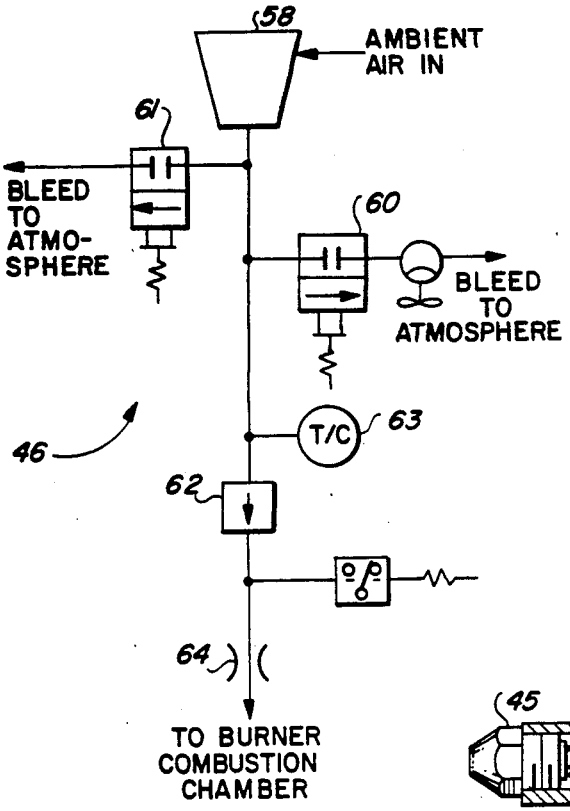
FIG. 3
FIG. 5
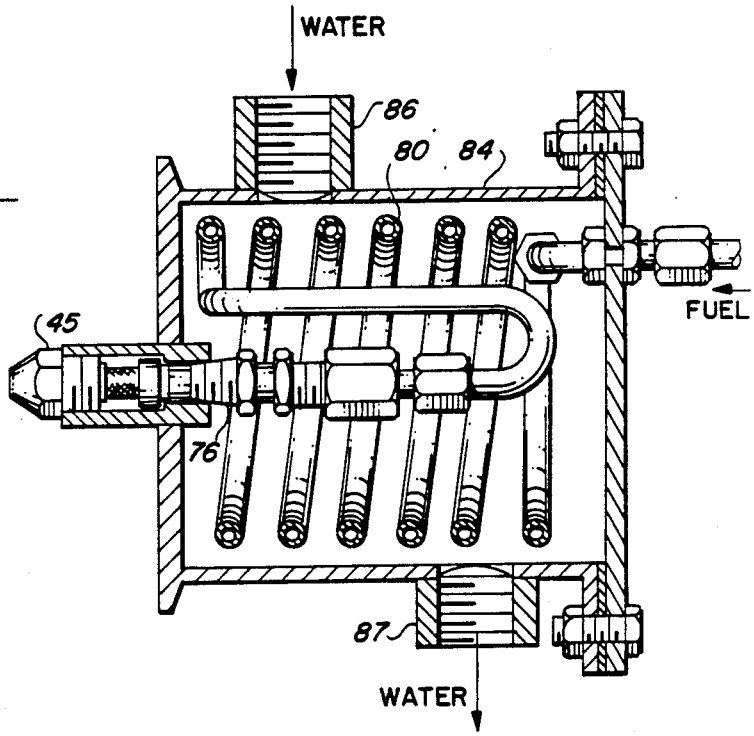
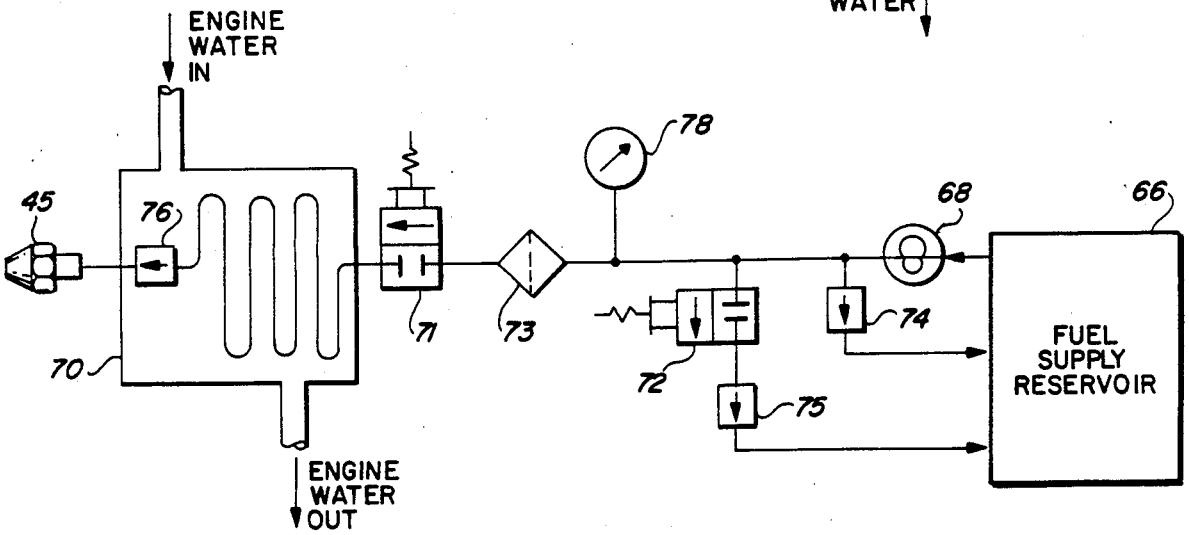
FIG. 4

DIESEL ENGINE PARTICULATE TRAP REGENERATION SYSTEM

BACKGROUND OF THE INVENTION

This invention relates to emission controls for vehicles powered by internal combustion engines, and more particuarly to a Diesel engine exhaust particulate trap and regeneration system.

Due to the increase in pollution control, federal and state governments have adopted stringent new standards for particulate emissions for all Diesel powered road vehicles. These new standards necessitate a new device in the Diesel engine exhaust system to remove the particulate. Such exhaust treatment is typically envisioned to consist of a filter or trap to collect the particulate from the exhaust gases. Associated with these filters or traps must be a system for periodically disposing of the filtered particulate. Periodic disposal of the filtered particulate is required because the particulate in the filter increase the engine exhaust back pressure thereby adversely affecting the fuel economy and vehicle performance. The most promising means of disposal of the particulate is by burning.

In order to burn the filtered particulate it is necessary to increase the exhaust gas temperature in the filter or trap. Under typical operation, Diesel engine exhaust temperature high enough to burn the particulate cannot be achieved. Therefore, a separate device is required to provide sufficient heat to burn the accumulated soot and maintain acceptable exhaust back pressure levels for good engine and turbocharger performance.

SUMMARY OF THE INVENTION

The present invention has been developed to eliminate the above-described problems. According to the apparatus of the present invention, a particulate trap regeneration system comprises an engine exhaust system, a burner, burner air and fuel supply systems and a controller. The engine exhaust system includes a particulate trap and a by-pass arranged in a parallel relationship, and a diverter valve and an associated actuator for directing the exhaust gas flow through either the particulate trap or the by-pass. The burner, located immediately upstream of the trap, supplies heated air to the trap in order to raise the particulate trap temperature to within a desired range to sustain regeneration. Pressure relief valves in the air supply system are opened and closed by the controller in response to sensed trap temperature in order to regulate the amount of air supplied to the burner. The controller is responsive to the pressure drop across the particulate trap in order to activate the regeneration cycle. Furthermore, the controller senses trap temperature in order to regulate the amount of air supply to the burner.

It is an object of the present invention to provide a diesel engine particulate trap and regeneration system to reduce pollution.

It is another object of this invention to provide an improved system for controlling the regeneration cycle of the particulate trap.

It is still a further object of this invention to provide a regeneration system capable of operation in subzero temperature environments.

BRIEF DESCRIPTION OF THE DRAWINGS

FIG. 3 is a schematic diagram of the air supply system used in association with the diesel fuel burner;

FIG. 4 is a schematic diagram of the fuel supply system used in association with the diesel fuel burner; and FIG. 5 is a cross-sectional view of the fuel heater used in the present invention.

DETAILED DESCRIPTION OF THE INVENTION

Figures 1, 2:
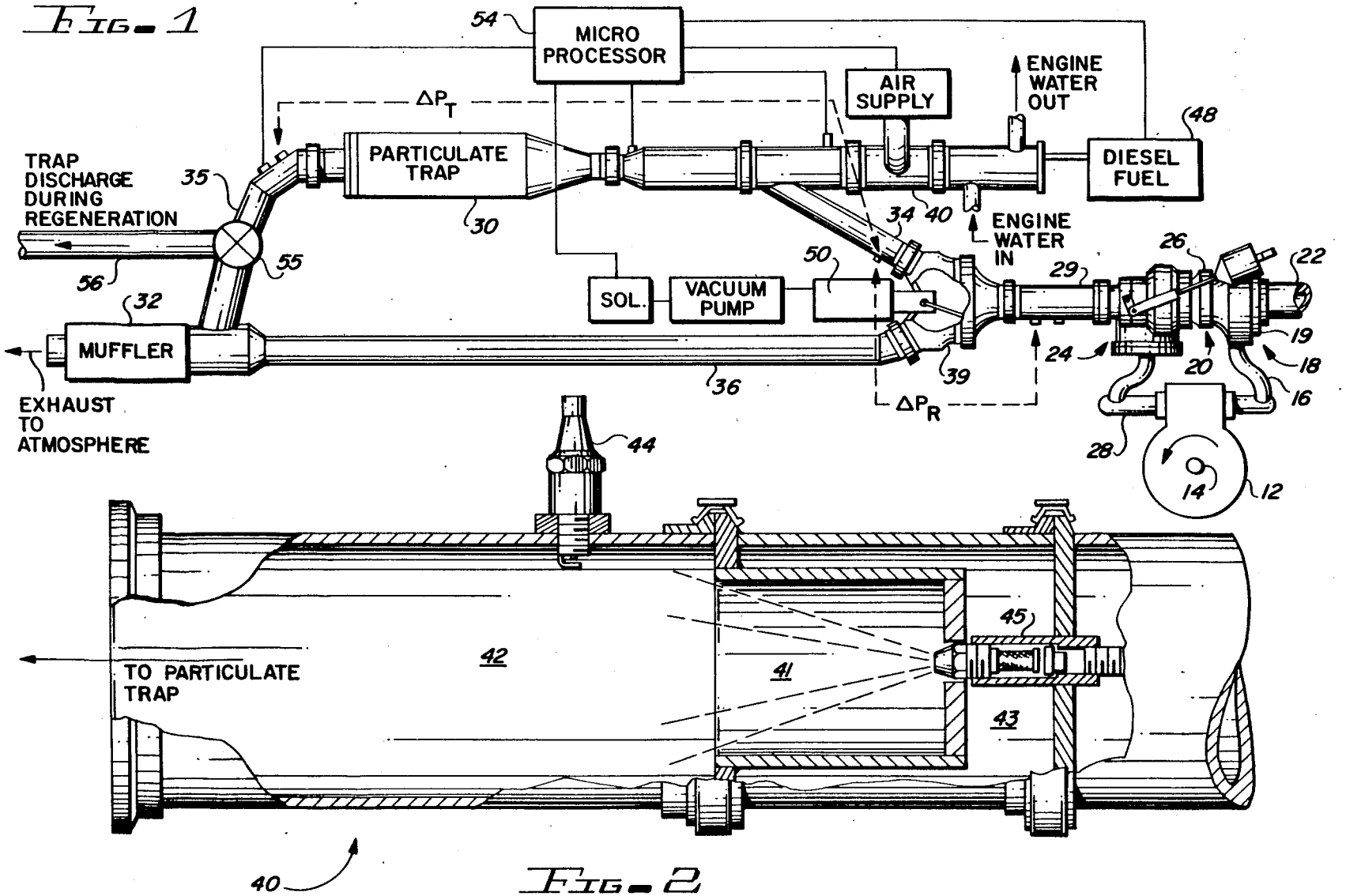
FIG. 1 is a schematic view of a turbocharged Diesel engine and the exhaust particulate trap regeneration system of the present invention.
FIG. 2 is a cross-sectional view of the diesel fuel burner.

A turbocharged engine particulate trap system is shown in FIG. 1 and generally comprises a combustion engine 12, such as a Diesel powered internal combustion engine having a plurality of combustion cylinders (not shown), for rotatably driving an engine crankshaft 14. The engine includes an air intake conduit or manifold 16 through which air is supplied by means of a compressor 18 of the turbocharger 20. In operation the compressor 18 draws in ambient air through an air inlet 22 into a compressor housing 19 and compresses the air with a rotatable compressor impeller (not shown) to form so-called charge air for supply to the engine for combustion purposes.

Exhaust products are discharged from the engine through an exhaust conduit or manifold 28 for supply to a turbine 24 of the turbocharger 20. The high temperature (up to 1000° C.) exhaust gas rotatably drives a turbine wheel (not shown) within the turbine housing 25 at a relatively high rotational speed (up to 190,000 RPM) to correspondingly drive the compressor impeller within the compressor housing 19. In this regard, the turbine wheel and compressor impeller are carried for simultaneous rotation on a common shaft (not shown) supported within a center housing 26. After driving communication with the turbine wheel, the exhaust gases are discharged from the turbocharger 20 to an exhaust outlet 29 which includes the pollution and noise abatement equipment of the present invention.

As shown in FIGS. 2–5, the particulate trap regeneration system comprises an engine exhaust system including a diverter valve 39 and actuator 50 and a diesel fuel burner system including air and fuel supply systems as will be discussed in detail below.

The exhaust system comprises a particulate trap 30, by-bass conduit 36, muffler 32 and exhaust piping 29, 34 and 35. The particulate trap is mounted in the engine exhaust system in parallel with the by-pass 36. Muffler 32 is located downstream of the junction of the flow through the particulate trap 30 and the bypass conduit 36. The diesel fuel burner 40 is located immediately upstream of the particulate trap inlet.

The particular design of the particulate trap is not envisioned as part of the present invention but is generally made of catalyzed ceramic foam elements in a steel enclosure and is designed to offer adequate trapping efficiencies to comply with federal restrictions. As such, it is subject to clogging as particulates are trapped. As shown in FIGS. 1 and 2 connections between the burner 40, trap 30 and diverter valve 39 are made using flanges and held together by with U-band clamps.

As shown in FIG. 2, burner 40 is made up of a combustion chamber 41 and a mixing chamber 42. Air from the air supply system, supplied via an air plenum 43, and atomized fuel from the fuel supply system are mixed in the combustion chamber 41. The mixing chamber 42, located immediately downstream of the combustion chamber, provides the length necessary for swirling combustion air to stabilize and mix with cooler air before entering the particulate trap 30. A spark plug 44 is located in a port near the upstream end of the mixing chamber for burner ignition.

The two-way diverter valve 39 directs exhaust flow from the engine 12 through the particulate trap 30 during normal operation and through the by-pass conduit 36 during regeneration cycles. Valve 39 is shown to be a flapper arm (FIG. 1) which is attached to and pivoted by a vacuum operated actuator 50; however, other types of valves can be used. Actuator 50 is spring loaded to hold the flapper arm against the valve seat to allow exhaust flow to the particulate trap 30. While vacuum is supplied to the actuator, the flapper moves into the bypass position, preventing exhaust flow to the trap and directing through the bypass conduit 36. During system operation, vacuum supply to the actuator 50 via vacuum pump 51 is triggered at the beginning of the regeneration cycle by actuation of a three-way vacuum solenoid valve 52 by controller 54.

A second diverter valve 55 is located immediately downstream of particulate trap 30 and operates as does diverter valve 39. During the regeneration cycle the second diverter valve 55 directs the exhaust from the trap 30 through conduit 56 to the atmosphere. During all other periods of operation, diverter valve 55 passes the trap discharge to muffler 32.

Controller 54 (available from Texas Instruments; Model 520 Programmable Controller) is programmed to allow burner operation only when the valve 39 is in the bypass position. This condition prevents the necessity of designing a burner to operate under a wide variety of pressure and flow conditions present in the exhaust stream during different driving modes. Because of this constraint, the controller 54 must be able to sense the position of the flapper arm of valve 39. Located within the actuator body are two microswitches (not shown) which function as indicators of the actuator rod position. The actuator rod is pivotably connected to flapper arm. One microswitch is triggered when the actuator rod is extended, the other when the rod is retracted.

The burner air supply system 46 includes a blower 58, two air bleed solenoids 60 and 61, a check valve 62 and an orifice 64 at the air inlet to the burner as shown schematically in FIG. 3. Blower 58 is powered by the vehicle battery (not shown) and supplies air to air plenum 43 of burner 40. Air bleed solenoid valves 60 and 61 are located downstream of the blower 58 and function to regulate air supply to the burner for control of burner temperature. Controller 54 is programmed such that both solenoids are open at the beginning of the regeneration cycle, allowing some air from the blower 58 to bleed off to the atmosphere. This feature ensures that the fuel-air mixture in the burner is fuel rich during ignition. As soon as the burner is lit, solenoids 60 closes and remains closed for the remainder of the regeneration cycle. The other solenoid valve 61 remains open as the burner temperature increases. When the temperature in the trap 30 reaches a predetermined level (i.e. 1400° F.) as sensed by controller 54, the second solenoid valve 61 closes so that all of the blower air is fed to the burner 40. This in turn decreases the fuelair ratio, causing the burner temperature to drop. As the burner inlet temperature falls to a predetermined level (i.e. 1200° F.), solenoid valve 61 opens and the burner temperature rises to a predetermined maximum temperature (i.e. 1400° F.). By opening and closing solenoid valve 61 in this way, the burner temperature can be held in the 1200°–1400° F. range as desired for soot oxidation in the trap. Check valve 62, located between the air bleed solenoid valves 60 and 61 and the burner 40, prevents reverse flow of hot burner or exhaust gases through the air supply system. The controller 54 also monitors the temperature via thermocouple 63 upstream of the check valve 62 to sense any exhaust leakage which may occur through check valve 62.

The fuel supply system 48 includes a fuel supply source 66, fuel pump 68, fuel heater 70, two shutoff solenoid valves 71 and 72, two pressure relief valves 74 and 75, a check valve 76, and a fuel atomizing nozzle 45 as shown schematically in FIG. 4. Fuel pump 68 is run via the engine battery, and since the fuel flow rate required by the regeneration system is so low, some of the fuel is redirected back to the fuel supply reservoir 66 through one or both of the pressure relief valves 74 or 75.

Fuel is delivered to the burner combustion chamber 41 through the atomizing nozzle 45. The nozzle sprays the fuel in a hollow cone pattern at a flow rate of 0.5 gallons per hour. A fuel filter 73 is installed upstream of the nozzle to prevent contaminants from plugging the small nozzle orifice. Fuel flow is controlled by shut-off solenoid valve 71.

The fuel system can be operated at one of two pressure settings as determined by the two pressure relief valves 74 or 75. Pressure relief valve 74 is generally set to regulate system pressure at approximately 90 psi (as measured at 79 in FIG. 4). This is the normal configuration of the fuel system. A lower fuel system pressure setting is available if air bleed modulation is not sufficient to keep the particulate trap inlet temperature below 1400° F. In this case, the controller opens solenoid valve 72 and the two pressure relief valves 74 and 75, work together to regulate fuel system pressure at approximately 80 psi.

Since the diesel fuel burner 40 must operate in subzero temperatures, a fuel heater 70 has been incorporated into the fuel supply system 48. As shown in FIG. 5, the fuel heater 70 comprises a coiled fuel line 80 immersed in a stainless steel can 84 having a water inlet and outlet connection (86 and 87) through which hot water from the engine 12 circulates. A fuel check valve 76, located inside the fuel heater can 84 at the nozzle inlet 45, limits residual fuel drippage through the nozzle into the burner combustion chamber 41 after fuel system shutdown.

The regeneration cycle is activated as follows: the pressure drop across particulate trap 30 ($\Delta P_T$) is monitored continuously by the system controller and compared to a reference pressure drop ($\Delta P_R$) measured across the diverter valve 39. As soot accumulates in the trap, $\Delta P_T$ increases with respect to $\Delta P_R$. Regeneration is automatically triggered by the controller when the ratio of $\Delta P_T$ to $\Delta P_R$ reaches a predetermined value which is an approximate indication of when the trap load limit is reached. This ratio is nearly independent of engine speed and load conditions. Controller 54 is also programmed to initiate a regeneration cycle if one has not occurred within a preset operational time interval, the maximum time allowable between regenerations.

When the regeneration cycle begins, exhaust gas is redirected by the diverter valve 39 to flow through the by-pass 36 instead of through the particulate trap 30. Controller 54 then activates the air and fuel supply systems and the ignition system to achieve burner light off and temperature modulation. The ignition system, powered by a 12 volt battery, generates a continuous spark for approximately 7 seconds at the beginning of the regeneration cycle after the fuel and air supply systems are activated. The burner lights during this period and is able to sustain combustion without the spark as long as fuel flow is uninterrupted. Hot gases from the burner, typically 1200° to 1400° F. and containing 5 to 10% oxygen, flow through the trap, oxidizing accumulated particulates. The trap discharges the flow through valve 55 and to atmosphere via conduit 56 during regeneration. At the end of the regeneration cycle, the fuel and air supply to the burner is shut off and the diverter valves 39 and 55 return to their spring loaded position, allowing exhaust to flow through the trap.

Engine exhaust gas exits the turbocharger turbine 24 and flows to either the particulate trap 30 or through bypass conduit 36. During vehicle operation the diverter valve 39 directs the exhaust gas to trap 30 where the particulate is filtered therefrom. The filtered exhaust gas is passed to the muffler 32 and then to the atmosphere. When controller 54 senses a predetermined pressure drop across the particulate trap, diverter valve 39 directs the exhaust gas to bypass conduit 36 and muffler 32 to atmosphere. Thereafter, controller 54 starts and controls the combustor operation in order to burn the filtered particulate in trap 30. Controller 54 regulates the amount of fuel and air supplied to the combustor by the fuel and air supply systems. This is accomplished by starting the fuel pump 68 and closing bleed air vent 60 and thereafter opening and closing bleed air vent 61 in response to burner combustion temperature. The exhaust products of the regeneration cycle are exhausted to the atmosphere via diverter valve 55 and conduit 56.

Various modifications to the depicted and described apparatus will be apparent to those skilled in the art. Accordingly, the foregoing detailed description of the preferred embodiment of the invention should be considered exemplary in nature, and not as limiting to the scope and spirit of the invention as set forth in the appended claims.

Having described in the invention with sufficient clarity that those skilled in the art may practice it, I claim:

1. A particulate trap system comprising:

a particulate trap for filtering exhaust gas entrained particles;

a bypass conduit in parallel with said particulate trap, said particulate trap and by-pass conduit connected to carry engine exhaust gas by suitable piping;

valve means for directing exhaust gas to said trap or said bypass conduit;

burner means upstream of said trap for burning the filtered particles, said burner means including a fuel and air supply systems, said fuel supply system further including a fuel source, a fuel pump, and means for varying the pressure of the fuel supplied to said burner means, said means for varying further including two pressure relief valves in parallel with each other and both in parallel with said fuel source and pump, and a means for opening and closing one of said pressure relief valves; and means for controlling the position of said valve means and the operation of said burner means.

2. The particulate trap system of claim 1 wherein said burner means further includes means for heating the fuel supplied to said burner means.

3. The particulate trap system of claim 1 wherein said burner means further includes means for controlling the burner temperature.

4. A particulate trap system comprising:

a particulate trap for filtering exhaust gas entrained particles;

a bypass conduit in parallel with said particulate trap, said particulate trap and by-pass conduit connected to carry engine exhaust gas by suitable piping;

valve means for directing exhaust gas to said trap or said by-pass conduit;

burner means upstream of said trap for burning the filtered particles, including fuel and air supply systems; means for controlling the burner temperature, said means for controlling the burner temperature further including two means for venting the air from the air blower to atmosphere in response to burner temperature; and means for controlling the position of said valve means and the operation of said burner means.

5. An exhaust gas regenerative particulate trap system comprising:

means for filtering out exhaust gas entrained particulate;

means for combusting said filtered particulate, including a burner, an air supply system, and a fuel supply system, said fuel supply system further including a fuel source, a fuel pump, and means for varying the pressure of the fuel supplied to said burner, said means for varying the pressure of the fuel further including two pressure relief valves in parallel with each other and both in parallel with said fuel source and said fuel pump, and means for opening and closing one of said pressure relief valves; and means, responsive to the pressure drop across said means for filtering, for starting and controlling said means for combusting.

6. The exhaust gas regenerative particulate trap system of claim 5 wherein said air supply system includes an air blower and means for controlling the combustion temperature.

7. An exhaust gas regenerative particulate trap system comprising:

means for filtering out of exhausat gas entrained particulate;

means for combusting said fitlered particulate including, a burner, a fuel supply system, and an air supply system, said air supply system further including an air blower and means for controlling the combustion temperature, said means for controlling the combustion temperature further including two bleed air vents to atmosphere, one of which is closed upon initiation of combustion, the second vent opens and closes in response to burner combustion temperature; and means responsive to the pressure drop across said means for filtering, for starting and controlling said means for combusting.

8. An exhaust gas regenerative particulate trap system comprising:

an engine;
an exhaust gas driven turbocharger;
a particulate trap;
a by-pass conduit in parallel with said particulate trap, and downstream of said turbocharger;
means for directing the engine exhaust gas to either said by-pass conduit or said particulate trap;
a combustor located immediately upstream of said particulate trap and including an atomizer and an ignition;
a air blower flow connected to said combustor;
means for varying the amount of air delivered to said combustor, including two bleed vents in series, one of which closes upon ignition of the combustor and the other opens and closes in response to combustion temperature;
a fuel source and pump flow connected to said atomizer; and
a means for varying the pressure of the fuel supplied to said atomizer.

9. The exhaust gas regenerative particulate trap of claim 8 further including a check valve between the bleed vents and the combustor.

10. An exhaust gas regenerative particulate trap system comprising:
an engine;
an exhaust gas driven turbocharger;
a particulate trap;
a bypass conduit in parallel with said particulate trap, and downstream of said turbocharger;
means for directing the engine exhaust gas to either said by-pass conduit or said particulate trap;
a combustor located immediately upstream of said particulate trap and including an atomizer and an ignition;
an air blower from connected to said combustor;
means for varying the amount of air delivered to said combustor;
a fuel source and pump flow connected to said atomizer; and
a means for varying the pressure of the fuel supplied to said atomizer, including two pressure relief valves in parallel with each other and a fuel source.

11. An exhaust gas regenerative particulate trap system comprising:
an engine;
an exhaust gas driven turbocharger;
a particulate trap;
a bypass conduit in parallel with said particulate trap, and downstream of said turbocharger;
means for directing the engine exhaust gas to either said by-pass conduit or said particulate trap;
a combustor located immediately upstream of said particulate trap and including an atomizer and an ignition;
an air blower flow connected to asid combustor;
means for varying the amount of air delivered to said combustor;
a fuel source and pump flow connected to said atomizer;
a means for varying the pressure of the fuel supplied to said atomizer; and
a fuel heater upstream of said atomizer.

12. The exhaust gas regenerative particulate trap system of claim 11 further including check valve between said heater and said atomizer.

13. A method for regenerating an exhaust gas particulate trap system comprising the step of:
filtering out exhaust gas entrained particulate in a filter;
burning the said filtered particulate in the presence of a sufficient amount of air; and
starting and controlling said burning step in response to the presence drop across the filter, said starting and controlling step further including varying said sufficient amount of air supplied during said burning step, further including:
closing a first bleed air vent to initiate burning; and
opening and closing a second bleed air vent to control burner combustion temperature.

14. A method for regenerating an exhaust gas particulate trap system comprising the steps of:
collecting exhaust gas particulate from engine exhaust gas in a filter;
directing the exhaust gas around the filter during selected periods;
combusting said filtered particulates; and
starting and controlling said burning step in response to the pressure drop across the filter, said starting and controlling said burning step including closing a bleed air vent to initiate burning; and opening and closing a second bleed air vent to control burner combustion temperature.

* * * * *

UNITED STATES PATENT AND TRADEMARK OFFICE

CERTIFICATE OF CORRECTION

PATENT NO. : 4,677,823

DATED : July 7, 1987

INVENTOR(S) : James A. Hardy

It is certified that error appears in the above-identified patent and that said Letters Patent is hereby corrected as shown below:

Col. 4, line 2, change "fuelair" to --fuel-air--.

Claim 7, Col. 6, line 52, change "exhausat" to --exhaust--.

Claim 7, Col. 6, line 54, change "fitlered" to --filtered--.

Claim 10, Column 7, line 36, change "from" to --flow--.

Claim 11, Column 8, line 9, change "asid" to --said--.

Claim 12, Column 8, line 18, between "including" and "check" insert --a--.

Claim 13, Column 8, line 27, change "presence" to --pressure--.

Signed and Sealed this

Twentieth Day of October, 1987

*Attest:*

DONALD J. QUIGG

*Attesting Officer*

*Commissioner of Patents and Trademarks*